US007675399B2

(12) United States Patent
Ebrey

(10) Patent No.: US 7,675,399 B2
(45) Date of Patent: Mar. 9, 2010

(54) REMOTE CONTROLLER DEVICE AND METHOD FOR HAND OPERATION OF FLOOR-MOUNTED AUDIO EFFECTS PROCESSORS

(76) Inventor: Simon Roger Ebrey, 467 Longleaf Ct, Lawrenceville, GA (US) 30045

( * ) Notice: Subject to any disclaimer, the term of this patent is extended or adjusted under 35 U.S.C. 154(b) by 125 days.

(21) Appl. No.: 11/656,831

(22) Filed: Jan. 23, 2007

(65) Prior Publication Data

US 2007/0176729 A1 Aug. 2, 2007

Related U.S. Application Data

(60) Provisional application No. 60/762,757, filed on Jan. 27, 2006.

(51) Int. Cl.
*H01C 10/00* (2006.01)

(52) U.S. Cl. ..... 338/153; 338/214; 338/202

(58) Field of Classification Search ..... 200/331, 200/332; 338/153, 160, 172, 180, 202, 214
See application file for complete search history.

(56) References Cited

U.S. PATENT DOCUMENTS 4,253,004 A * 2/1981 Oka ..... 200/331
4,291,212 A * 9/1981 Bui ..... 200/331
5,046,143 A * 9/1991 Uher ..... 200/331
5,305,418 A * 4/1994 Tuttle ..... 392/449
5,451,730 A * 9/1995 Phillips, Sr. ..... 200/43.11
5,486,661 A * 1/1996 Jambor et al. ..... 200/47
6,504,460 B2 * 1/2003 DeGrazia et al. ..... 335/68
6,590,756 B2 * 7/2003 Meiners et al. ..... 361/62
6,706,984 B1 * 3/2004 Turner ..... 200/331
6,765,163 B2 * 7/2004 Aguado et al. ..... 200/330
6,852,919 B2 2/2005 Ludwig

OTHER PUBLICATIONS

Tone in Progress, Inc. "Give Yourself a 3rd Hand." [Internet website] est. 2005 initial publication; www.toneinprogress.com.
The Musician's Friend Central User Reviews. "Effects Reviews> Tone in Progress>Third Hand" [Internet website] est. 2004 publication; http://reviews.harmony-central/reviews.
Music Culture Plaza Ikebe; "Pedalflex" [Internet website, originating in Japan]; published Sep. 1, 2008; www.rakuten.co.jp/ikebe/443900/838383/.

* cited by examiner

*Primary Examiner*—Kyung Lee
(74) *Attorney, Agent, or Firm*—James T. Hollin, Jr.; JT Hollin, Attorney at Law PC

(57) ABSTRACT

Disclosed is a device for the remote operation of the variable audio controls of floor-mounted audio effects devices, such devices typical of those used by performing artists on stage. The vast majority of devices of this type are operated by a foot pedal-controlled on/off switch and rotary operated potentiometer switch(es) to vary the audio output. The present inventive concept uses a variety of mechanical connectors, which couple the rotary switches of the floor device to a hand-operated controller mounted on a microphone or accessory stand. In this manner a performer is able to operate the effects device, with his/her hand, from a more natural standing position during a musical performance, rather than having to crouch down during said performance.

8 Claims, 7 Drawing Sheets

BILL OF MATERIAL

2 KNOB
4 SHAFT COLLAR
6 SET SCREW
8 BUSHING
10 BRACKET
12 CLIP
14 MACHINE SCREW
16 LOCK WASHER
18 FLAT WASHER
20 NUT
22 HEAT SHRINK
24 WIRE ROPE
26 UNIVERSAL JOINT
28 RING
30 THUMB SCREW

REMOTE CONTROLLER DEVICE AND METHOD FOR HAND OPERATION OF FLOOR-MOUNTED AUDIO EFFECTS PROCESSORS

CROSS REFERENCE TO RELATED APPLICATIONS

This application claims the benefit of provisional patent application Ser. No. 60/762,757, filed Jan. 27, 2006 by the present inventor.

FEDERALLY SPONSORED RESEARCH

Not Applicable

SEQUENCE LISTING OR PROGRAM

Not Applicable

BACKGROUND OF THE INVENTION

1. Field of Invention

This inventive concept is applicable to devices with slightly differing names, including "audio signal processor, ""audio effects processor,"or the like, and in particular, methods and apparatus for operating floor-mounted devices of this type.

2. Prior Art

With the further development of electronic musical instruments in the mid-1960's, and the implementation of digital technology in the 80's and 90's, small, floor-mounted audio effect processors (FIG. 1) have become widely popular tools for enhancing and manipulating audio signals produced by electronic musical instruments, particulary the electric guitar.

These small, battery operated devices usually consist of a metal housing containing the various electronic components, a foot operated on-off switch, and a plurality of rotary potentiometers (FIG. 2) which provide independent adjustment of the various operating parameters and functions of the device.

It should be noted that, other than the differences in the type of effect available, the size/shape of the housing, and the number of rotary potentiometers, used to vary the audio effects, the basic configuration of these devices has remained virtually unchanged in the forty years since their introduction, and though a multitude of floor-mounted effects devices are now used world wide, several inadequacies are inherent in their operation:

1) Control over the devices is limited to the foot-operated on/off switch which only engages a pre-set effect to an audio signal. (Provides no actual manipulation or control over the effect.)
2) Being floor-mounted, access the manual controls (rotary potentiometers) is unavailable during normal use without the user stooping or crouching down. (This is often unpractical as the user is usually required to maintain a standing or sitting position in order to play his/her instrument, sing at a stand-mounted microphone, or more frequently, both.)
3) In order to make any adjustment to the manual controls, the user must either:
   a) Make any adjustments prior to each song/piece and hope the adjustment was accurate (This is inherently difficult due to the need of an audio signal as well as the exact tempo of the song/ performance in order to make adjustments that are often measured in milliseconds.)

b) Wait until a pause in the song/performance provides time for the user to bend over and make a quick (and usually innaccurate) adjustment, all while his/her eyes constantly must adjust to an ever-changing or dimly-lit lighting situation.

Recently, one company has attempted to address this problem by marketing a floor-mounted apparatus that is designed to be positioned directly alongside the effects device it connected to.

A small metal housing with approximately the same dimensions as typical effect pedal has protruding from its top surface a short flexible metal shaft approx. 30 cm in length and a foot-operated see-saw lever. The shaft is rotated by a simple gear arrangement powered by the up and down movement of the foot lever.

Once the apparatus is in position next to an effect pedal, the flexible shaft is bent over 180° and attached to an effect pedals exposed potentiometer shaft with a hex wrench and set-screw.

A photographic representation of the currently marketed device is included in the Information Disclosure Document.

There are however, several inefficiencies in the currently marketed device:

1) Unnecessarily complicated/costly design.
2) Takes up extra floor space during performances/use.
3) Due to its shorter drive shaft, the currently marketed device can only function when placed directly next to an effects pedal:

If the user wishes to use the currently marketed device with an elongated effects processor (commonly known as a pedalboad) he/she is limited to those pedalboards having their control knobs located on either the extreme right or left hand side.

Note that many pedalboards are equipped with see-saw type foot levers on one or both sides and are thus restricted from use with the currently marketed device.
4) The currently marketed device is capable of controlling only one rotary potentiometer at a time.

Even a two-channel version of this device would be too bulky and cost prohibitive to be practical.
5) Guitar players are used to making adjustments to control knobs with their hands not their feet. When trying to make fast, precise adjustments in increments that are often measured in milliseconds, replacing the control knob with yet another foot-operated apparatus does not efficiently, much less naturally solve the problem, it merely reconfigures it.

OBJECTS AND ADVANTAGES

Accordingly, several objects and their advantages of this remote control are presented below:

1) To provide operational control of floor-mounted audio effects devices from either a standing or sitting position with a device which:
   a) is cheaper to produce than the currently marketed device.
   b) is more discrete in operation than the currently marketed device - requires no floor space.
   c) may be used with any floor-mounted effects devices whether pedal or pedal-board type, regardless of the configuration of their potentiometers or foot-operated levers.
   d) can accomodate several potentiometers on any combination of processors with a single unit rather than the single potentiometer capability of the currently marketed device.

e) is more natural to operate for the user than the currently marketed devices, which is foot-operated.

2) To signifigantly expand the performance applications of floor-mounted audio effects processors.

3) To establish an entirely new field of creative exploration and expression that did not previously exist.

Another advantage of this remote controller is its usefulness to musicians other than guitarists;

Vocal performers, Keyboardists, Recording Engineers, as well as "Solo" performers (who frequently have to operate multiple devices equipped with rotary potentiometers), will find this remote controller useful.

Also, due to the instrument-like characteristic resulting from the manipulation of a rotary potentiometer while an audio signal is present, the employment of this remote control enables the effects device itself to become a functional, playable 'instrument' with its own unique characteristics and potential. Thus, a useful synergy is made more accessable for practical application by musicians, singers, etc., further expanding the already signifigantly increased performance applications now possible with floor-mounted audio effects devices.

This invention not only provides a discreet, practical, economical and easy-to-use solution to a problem that has existed for over forty years, but also signifigantly expands their performance applications of the floor-mounted audio effect processors by allowing manipulation of their controls from a more natural position for the user.

Still further objects and advantages will become apparent from a consideration of the ensuing drawings and descriptions.

DRAWINGS—FIGURES

DESCRIPTION PREFERRED EMBODIMENT

Figure 1:
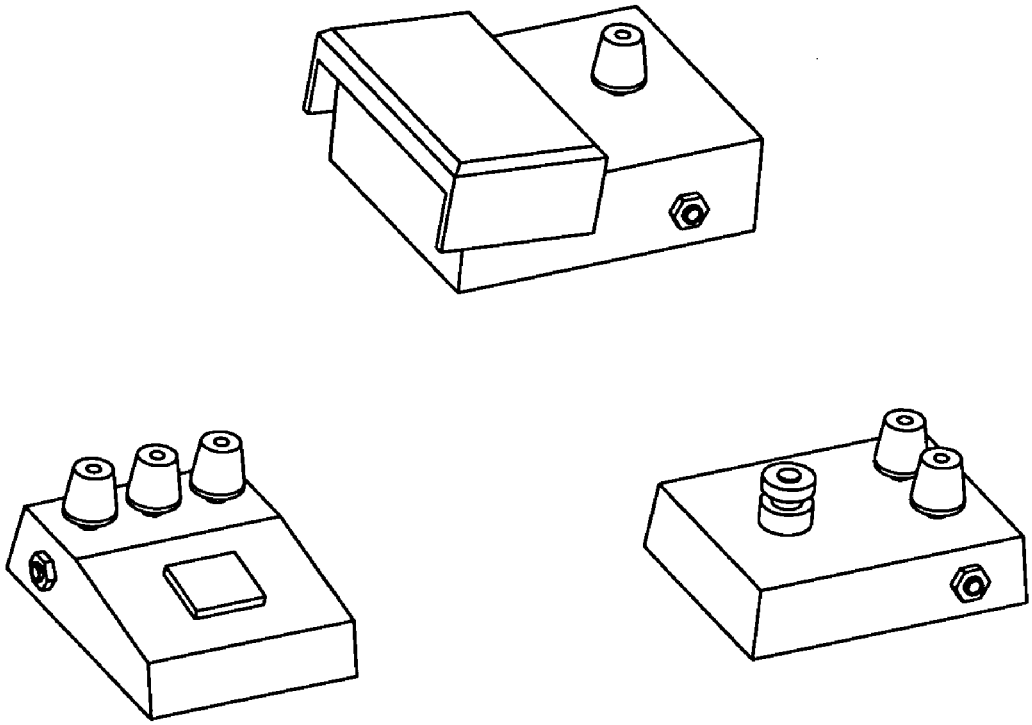
FIG. 1 Shows three examples of typical floor-mounted audio effects devices.
Figure 2:
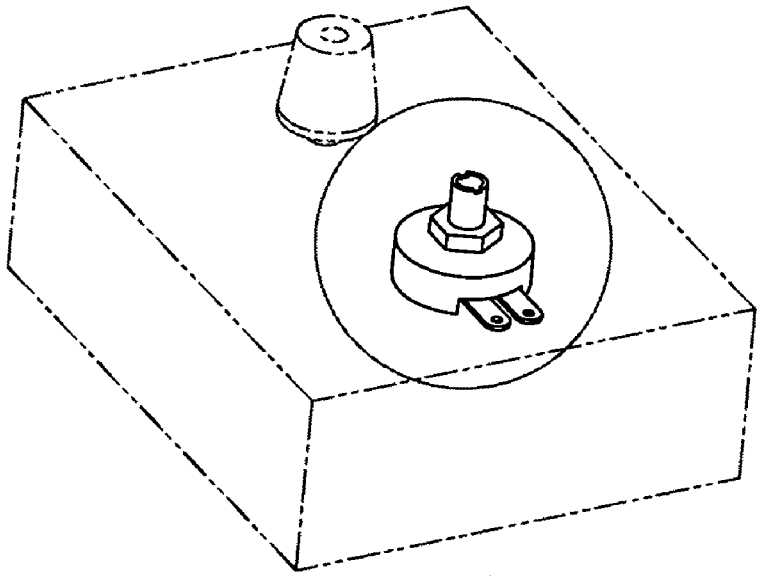
FIG. 2 Shows view of rotary potentiometer.

A piece of vinyl-coated, 7×7 strand, galvanized steel wire rope 24 approximately 91.4 cm in length and 0.47 cm in diameter is passed through a hole of equal diameter in a 5×2.5 cm mounting bracket 10, and is allowed to swivel in place 360° by means of a pair of shaft collars 4. Each having a set screw 6. A pair of 0.63 cm (I.D.) nylon bushings 8, are used to reduce friction, and both ends of the wire rope have a 2.5 cm length of 0.025 inch thickness vinyl heat-shrink 22 to provide a "snug" fit of the shaft collars and the universal joint 26.

A 1.8 cm diameter control knob 2 is epoxied in place directly over the shaft collar assembly for transmitting the hand-generated rotational force required to operate the remote. The mounting bracket is then attached to a microphone stand with a pair of steel clips 12 approximately 91.4 cm from ground level.

Approximately 30 cm below the control unit, a 3.8 cm diameter steel pinch clamp 28, which is provided with a steel clip identical to the above 12, is attached to the microphone stand to act as a loom and restrict lateral movement of the wire rope 24 during operation. Both the loom clip and the control unit clips are attached with a machine screw 14 and lock washer 16 and fastened with a flat washer 18, and a hex nut 20.

A universal joint 26 having an approximate length of 7 cm and inside bore of 0.63 cm is attached to the bottom end of the wire rope with general purpose epoxy, and a thumb screw 30 at the open end of the universal joint is used to "capture" and hold the potentiometer shaft.

This preferred embodiment is not limited to a single control; as many floor-mounted processors are equipped with several rotary potentiometers, a 2, 3, or 4 channel model is also a practical embodiment.

Description-operation

Preferred Embodiment

Figure 3:
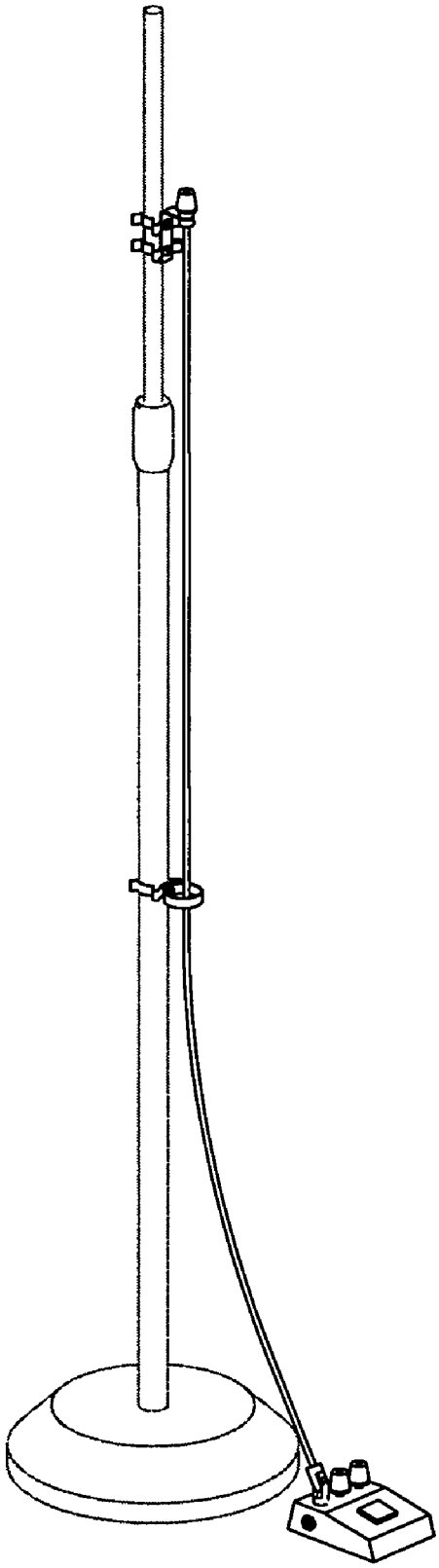
FIG. 3 Shows remote controller in static (operating) position.
Figure 4A:
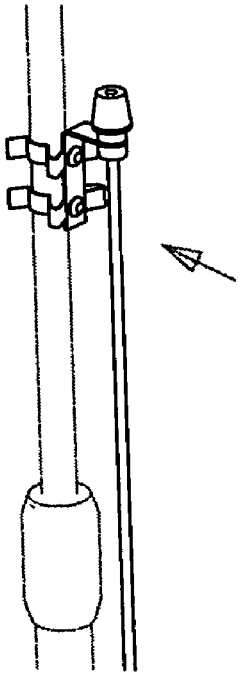
FIG. 4A Shows control unit being clipped to microphone stand.
Figure 4B:
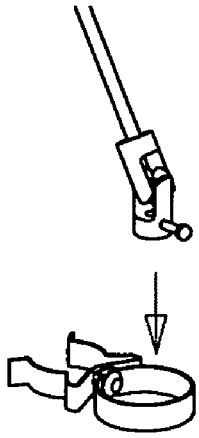
FIG. 4B Shows wire rope being passed through loom assembly.
Figure 4C:
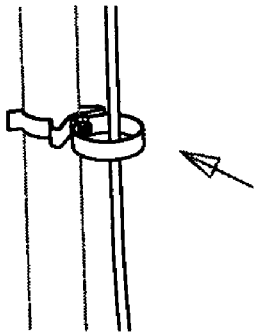
FIG. 4C Shows loom assembly being clipped to microphone stand.
Figure 4D:
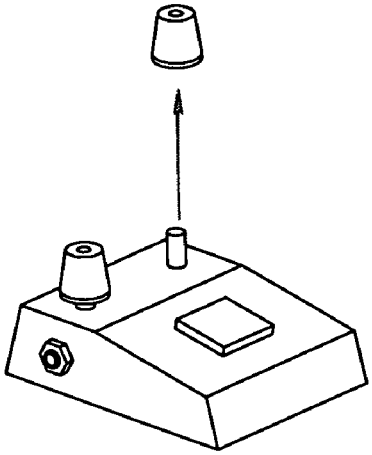
FIG. 4D Shows removal of knob from audio signal processor.
Figure 4E:
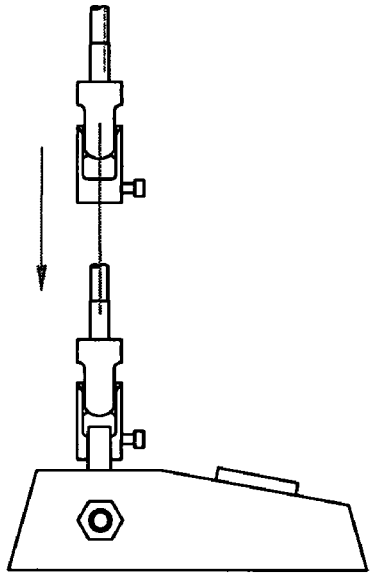
FIG. 4E Shows u-joint in position over potentiometer.
Figure 4F:
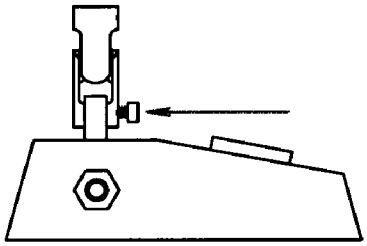
FIG. 4F Shows thumb screw operation.

Operation—FIGS 3 through 4F

FIG. 3 shows device in operating position.

The control unit is first clipped to a microphone stand approximately 91.44 cm from the floor (FIG. 4A). The bottom end of the cable is then passed through the loom assembly (FIG. 4B), which is similarly clipped approximately 30 cm below the control unit (FIG. 4C).

The user then removes from his/her effects device the knob controlling the desired parameter (FIG. 4D), and turns the exposed potentiometer shaft to its "0" setting. The control knob of the remote is then also set to its "0" position.

Finally, the open bore of the universal joint is pushed into position over the exposed potentiometer shaft (FIG. 4E) and held in place with a thumb screw (FIG. 4F).

Figure 5:
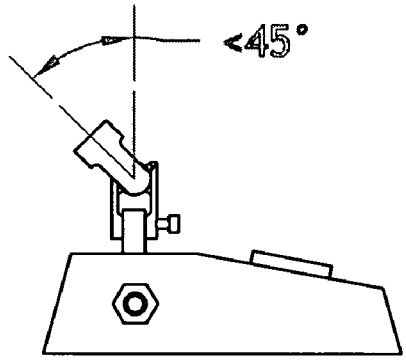
FIG. 5 Shows view of universal-joint operation.

U-joint allows complete freedom of movement from any direction up to 45° from the vertical (FIG. 5).

Alternative Embodiments

Figure 7A:
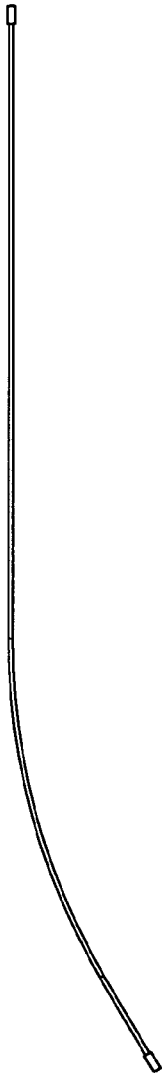
FIG. 7A Show example of flexible drive shafts (alternative embodiments).
Figure 7B:
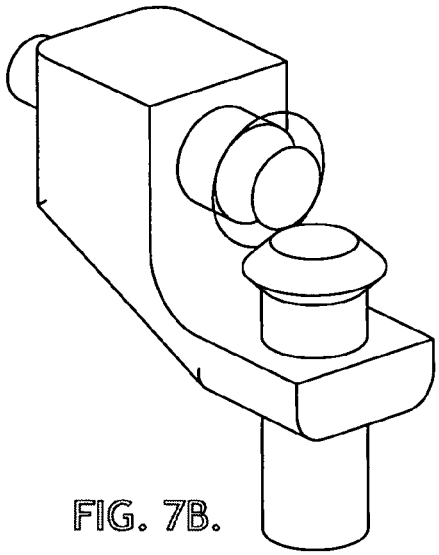
FIG. 7B Shows geared mechanism (alternative embodiment).
Figure 7C:
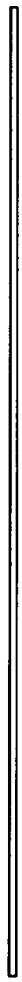
FIG. 7C Shows example of rigid drive shaft.
Figure 8:
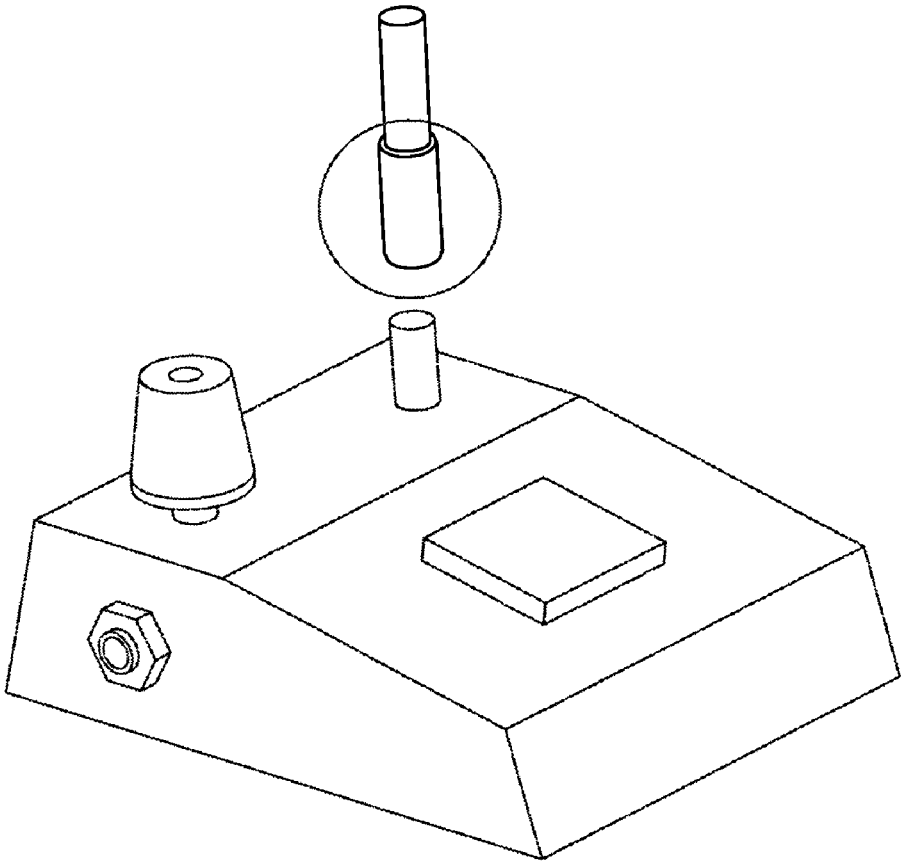
FIG. 8 Shows example of flexible rubber hose or flexible tubing (alternative embodiment).

While the preferred embodiment incorporates a length of vinyl-coated wire rope and a nylon universal joint as the primary components of this remote, an additional embodiment could employ a panel-mount flexible drive shaft (FIG. 7A) in conjunction with a 90°, geared mechanism (FIG. 7B).

Figure 6:
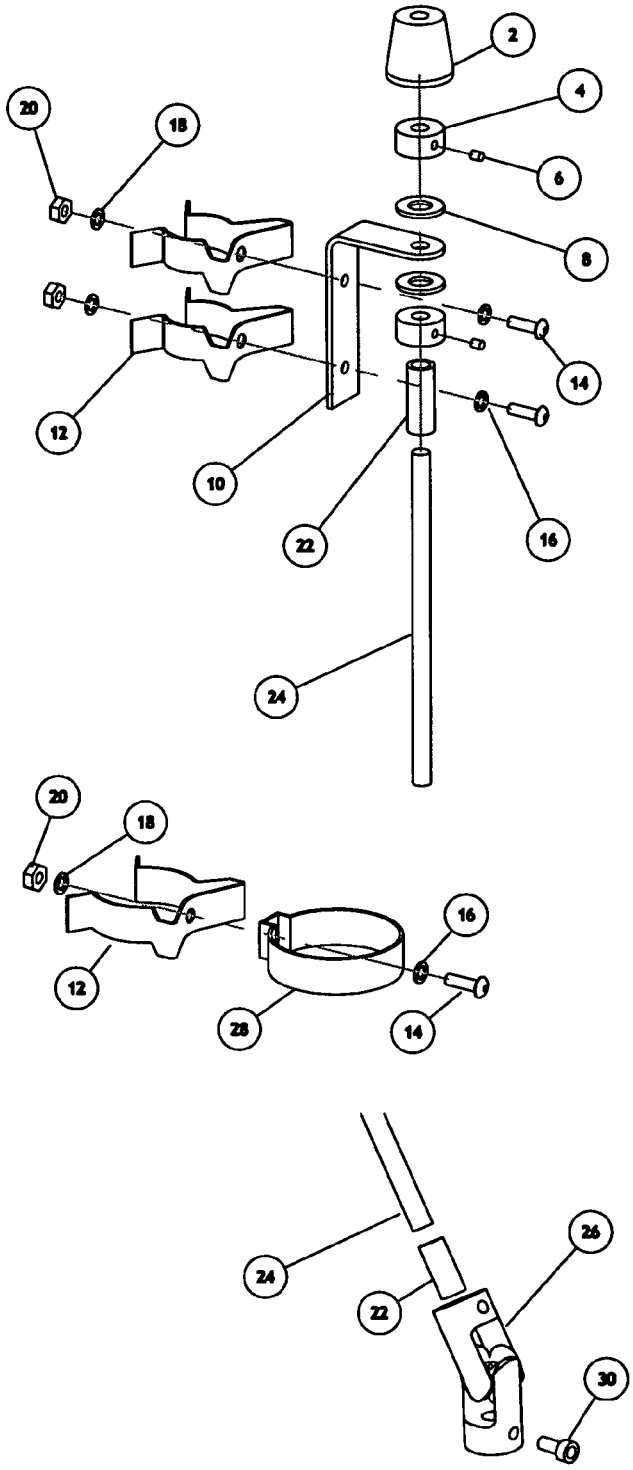
FIG. 6 Is exploded view of preffered embodiment.

Alternately, a rigid shaft (FIG. 6C) constructed of a cheap, lightweight material (such as plastic) would, when combined with the nylon u-joint, result in a more discrete operational profile.

Also, a length of flexible rubber hose or other pliable tubing having an inside diameter of approximately 0.63 cm (FIG. 6D) may be used in place of the universal joint to capture the potentiometer shaft.

Still further, by utilizing the small, powerful micro-servos available today (like those used in radio-controlled hobby aircraft, cars, etc.,) a 'wireless' remote, capable of controlling multiple potentiometers from practically anywhere during a live performance, is yet another possible embodiment.

This would be useful not only with floor-mounted devices, but with any device equipped with rotary potentiometers, such as amplifiers, mixing consoles, etc,.

I claim:

1. A device for the remote operational control of floor-mounted audio effects processors, comprising a bracket having a means of attachment to a microphone stand or other similar on-stage equipment;

a control mechanism affixed to said bracket, said control mechanism manually operable so as to apply a hand-generated force to a receiving object;

a longitudinal receiving object having two ends, (a) a receiving end and (b) a transmitting end;

a means of coupling the receiving end of said receiving object to said control mechanism; and a means of coupling the transmitting end of said receiving object to a shaft of a rotary potentiometer integral to an audio effects processor.

2. A device as in claim 1, further comprising a receiving object comprising a length of an elongated, rigid cylinder, having an upper end and a lower end, with each end of said cylinder approximately 0.63 cm in diameter;

a means of coupling said control mechanism to said upper end of said elongated, rigid cylinder; and a means of coupling the lower end of said elongated, rigid cylinder to a shaft of a rotary potentiometer integral to an audio effects processor.

3. A device as in claim 1, wherein said means of coupling the transmitting end of said elongated cylindrical structure to a shaft of a rotary potentiometer comprises a geared mechanism, said geared mechanism further comprising a first bevel gear and a second bevel gear, wherein the drive shaft of said first bevel gear is connected to the transmitting end of said elongated cylindrical structure and the drive shaft of said second bevel gear is connected to the shaft of said rotary potentiometer.

4. A device for the remote operational control of floor-mounted audio effects processors, comprising a bracket having a means of attachment to a microphone stand or other similar on-stage equipment;

a control mechanism affixed to said bracket, said control mechanism manually operable so as to apply a rotational force to a receiving object;

a receiving object comprising an elongated cylindrical structure, said elongated cylindrical structure having two ends, (a) a receiving end and (b) a transmitting end;

a means of coupling the receiving end of said elongated cylindrical structure to said control mechanism; and a means of coupling the transmitting end of said elongated cylindrical structure to a shaft of a rotary potentiometer, said potentiometer being integral to an audio effects processor.

5. A device as in claim 4, further comprising a 3.8 cm diameter steel pinch clamp encompassing said elongated cylindrical structure at its approximate mid-length, said steel pinch clamp being secured to said microphone stand or other on-stage equipment by means of a steel clip.

6. A device for the remote operational control of a floor-mounted audio effects processor, comprising a 2.5 cm right-angle L-shaped mounting bracket having a 0.47 cm diameter hole in one segment of said L-shape;

a first shaft collar having at least a 0.50 cm diameter hole and having an integral setscrew;

a second shaft collar having at least a 0.50 cm diameter hole and having an integral setscrew;

a first nylon bushing and a second nylon bushing, each nylon bushing having a 0.63 cm inside diameter;

a length of vinyl-coated, 0.7 times 0.7 strand, galvanized steel wire rope approximately 0.47 cm in total diameter, having an upper end and a lower end and further, both ends having a 2.5 cm length of 0.063 inch thickness vinyl heat shrink treatment;

a control knob; and a universal joint having a length of approximately 7.0 cm, said universal joint having an upper opening and a lower opening, said lower opening containing an integral thumbscrew, and further, both openings having an inside bore of 0.63 cm, wherein the L-shaped mounting bracket is affixed to a microphone stand or similar on-stage equipment, thereby enabling the simultaneous concentric alignment of the first shaft collar and first bushing on one side of the 0.47 cm diameter hole and the second shaft collar and second bushing on the opposite side of said hole, whereupon the upper end of said steel wire rope is inserted into the second shaft collar and continued on through said first shaft collar, thereafter said first setscrew and said second setscrew are rotated a sufficient amount to secure said wire rope, thereafter placing the control knob onto the perimeter of said first shaft collar and afterwards, inserting the lower end of said wire rope into the upper opening of said universal joint, and placing the lower opening of said universal joint onto the exposed shaft of the rotary potentiometer of an audio effects processor, securing the lower opening of said universal joint, by means of said thumbscrew, onto said exposed shaft.

7. A device for the remote operational control of floor-mounted audio effects processors, comprising:

a 2.5 cm right-angle L-shaped mounting bracket having a minimum 1.0 cm diameter hole in one segment of said L-shape;

a first shaft collar having a minimum 1.0 cm diameter hole and having an integral setscrew;

a second shaft collar having a minimum 1.0 cm diameter hole and having an integral setscrew;

a first nylon bushing and a second nylon bushing, each nylon bushing having a 1.0 cm inside diameter;

a length of tubing having an upper end and a lower end, said tubing having an inside diameter of approximately 0.63 cm, and further, the upper end of said tubing being inserted through said second and first shaft collars, and clutchingly attached within said shaft collars by means of said setscrews;

a knob affixed to said first shaft collar such that said knob is capable of transmitting a rotary force onto the outer circumference of said first shaft collar, and thereby, onto said tubing; wherein said L-shaped mounting bracket is affixed to a microphone stand or similar on-stage equipment, thereby enabling the simultaneous concentric alignment of said first shaft collar and first bushing on one side of said minimum 1.0 cm diameter hole and said second shaft collar and second bushing on the opposite side of said hole, whereupon the upper end of said tubing is inserted into the second shaft collar and continued on through said first shaft collar, thereafter said first setscrew and said second setscrew each being rotated a sufficient amount to secure said tubing, and further, placing said control knob onto the perimeter of said first shaft collar and afterwards, placing the lower end of said tubing over the exposed shaft of the rotary potentiometer of an audio effects processor, securing said placement by a suitable fastening means to said shaft.

8. A device for the remote operational control of floor-mounted audio effects processors, comprising a bracket having a means of attachment to a microphone stand or other similar on-stage equipment;

a plurality of control mechanisms affixed to said bracket, each said control mechanism manually operable so as to apply a hand-generated force to a receiving object;

a plurality of longitudinal receiving objects, each said receiving object having two ends, (a) a receiving end and (b) a transmitting end;

a means of coupling the receiving end of any one of said receiving objects, singularly, to one of said control mechanisms; and a means of coupling the transmitting end of each of said receiving objects, singularly, to a shaft of at least one rotary potentiometer integral to at least one audio effects processor.

* * * * *